US010548421B1

(12) United States Patent
Lositisuk

(10) Patent No.: US 10,548,421 B1
(45) Date of Patent: Feb. 4, 2020

(54) MULTI-COMPARTMENT BEVERAGE CONTAINER

(71) Applicant: Manus Lositisuk, Palatine, IL (US)

(72) Inventor: Manus Lositisuk, Palatine, IL (US)

( * ) Notice: Subject to any disclaimer, the term of this patent is extended or adjusted under 35 U.S.C. 154(b) by 0 days.

(21) Appl. No.: 16/278,117

(22) Filed: Feb. 17, 2019

(51) Int. Cl.
*A47G 19/22* (2006.01)
*B65D 1/26* (2006.01)
*B65D 43/02* (2006.01)
*B65D 25/04* (2006.01)

(52) U.S. Cl.
CPC ..... *A47G 19/2205* (2013.01); *B65D 1/265* (2013.01); *B65D 25/04* (2013.01); *B65D 43/0202* (2013.01); *B65D 2543/00046* (2013.01)

(58) Field of Classification Search
CPC ..... A47G 19/2205; B65D 25/04; B65D 43/0202; B65D 1/265; B65D 2543/00046
USPC ..... 222/129–145.8; 220/501
See application file for complete search history.

(56) References Cited

U.S. PATENT DOCUMENTS 4,333,581 A * 6/1982 Flansburg ..... B65D 17/4012 220/501
7,670,479 B2 * 3/2010 Arett ..... A47G 19/12 210/474
7,967,135 B2 * 6/2011 Boatner ..... B65D 1/12 206/222
8,365,960 B1 2/2013 Kalaouze
8,469,227 B2 * 6/2013 Tripsiznes ..... A47G 19/2272 215/17
8,967,412 B2 * 3/2015 Loging ..... A47G 19/2272 206/219
2008/0116221 A1 * 5/2008 Roth ..... B65D 47/243 222/129
2010/0163442 A1 * 7/2010 Lee ..... B65D 47/243 206/222
2012/0261375 A1 * 10/2012 Loging ..... A47G 19/2272 215/11.4
2013/0240564 A1 * 9/2013 Albaum ..... B65D 47/2031 222/129

* cited by examiner

*Primary Examiner* — Kareen K Thomas
(74) *Attorney, Agent, or Firm* — Underwood & Associates, LLC

(57) ABSTRACT

A multi-compartment beverage container includes a first container, including a first floor and a first circumferential wall having a first height and a first upper-most rim portion, a second container, including a second floor and a second circumferential wall having a second height and a second upper-most rim portion, a vacuum relief bore; a filling aperture, and a lid member including a top side and a bottom side configured to engage the first upper-most rim portion. The second container is configured to fit within the first container and be held in an upper half of the first container.

12 Claims, 3 Drawing Sheets

MULTI-COMPARTMENT BEVERAGE CONTAINER

TECHNICAL FIELD

This disclosure relates to a beverage container having a main chamber and an internal cooling chamber. The internal cooling chamber includes an aperture allowing liquid to be transferred from the main chamber into the cooling chamber.

BACKGROUND

It is well known that hot beverages can pose a burn risk to those consuming them. Beverages such as coffee, tea and hot chocolate are commonly served at 160 degrees or hotter which can cause scald burns even if the exposure is brief. Cup lids commonly include an aperture through which consumers can drink the beverage; however, such lids can increase the risk of burns as the user is usually less adept at creating an air/liquid mix through the aperture compared to sipping.

The consumer is typically left with few options when presented with a beverage that is too hot to drink, including simply waiting for the beverage to cool and removing the lid to blow on it. The latter option can present its own safety concerns due to spillage, especially if the consumer is driving. Thus, development of a beverage container having a dedicated interior cooling reservoir is an unmet consumer need.

SUMMARY

In one exemplary aspect, a multi-compartment beverage container is disclosed. The multi-compartment beverage container includes a first container, itself including a first floor and a first circumferential wall having a first height and a first upper-most rim portion. The multi-compartment beverage container includes a second container including a second floor and a second circumferential wall having a second height and a second upper-most rim portion, a vacuum relief bore; and a filling aperture. The multi-compartment beverage container further includes a lid member including a top side and a bottom side configured to engage the first upper-most rim portion, wherein the second container is configured to fit within the first container and be held in an upper half of the first container.

In one embodiment, the vacuum relief bore is disposed from between 1 mm and 10 mm from the second upper-most rim portion of the second container.

In one embodiment, the filling aperture is disposed from between 1 mm and 10 mm from the second upper-most rim portion of the second container.

In one embodiment, the lid member includes a drinking aperture disposed on a first axis, and wherein the filling aperture is disposed on a second axis that is substantially orthogonal to the first axis. The drinking aperture can be disposed on the second axis between 0° and ±5° to the first axis, between 0° and ±10° to the first axis, between 0° and ±15° to the first axis, between 0° and ±20° to the first axis, for example.

In one embodiment, the vacuum relief bore is diametrically opposite to the filling aperture.

In one embodiment, the lid member further includes a rim portion that extends at a non-zero angle to the second circumferential wall. The rim portion can have a diameter that is greater than a diameter of the first upper-most rim portion of the first container.

In one embodiment, the second upper-most rim portion of the second container is joined with the bottom side of the lid member. The lid member and the second container can be coaxially aligned.

In one embodiment, the multi-compartment beverage container further includes a filter disposed in, on or across the filling aperture.

In one embodiment, the second height of the second circumferential wall is between one-quarter and one-third of the first height of the first circumferential wall.

In one embodiment, the second height of the second circumferential wall is between one-quarter and one-half of the first height of the first circumferential wall.

In one exemplary aspect, a multi-compartment beverage container is disclosed. The multi-compartment beverage container includes a first container, a second container configured to fit within, and be held in an upper half of the first container, the second container including a vacuum relief aperture and a filling aperture, and a lid member configured to engage the first container including a drinking aperture disposed on a first axis.

In one embodiment, the filling aperture is disposed on a second axis that is substantially orthogonal to the first axis. The second container can have a height that is less than, or equal to one-half of a height of the first container.

In one exemplary aspect, a multi-compartment beverage container is disclosed, including a first container, a second container configured to fit within, and be held in an upper half of the first container, a lid member configured to engage the first container and at least one aperture disposed in the second container for filling the second container with a volume of liquid disposed in the first container.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

Figure 1:
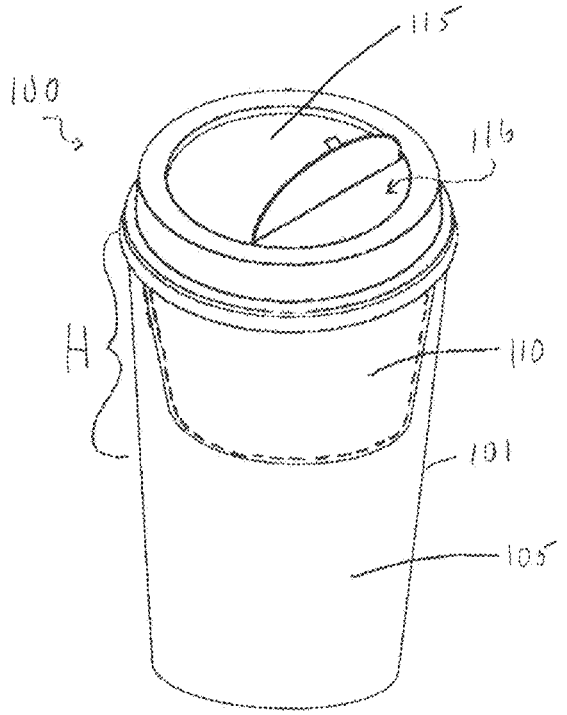
FIG. 1 is a multi-compartment beverage container according to one embodiment.

FIG. 1 is a multi-compartment beverage container (hereinafter 'container') 100 according to one embodiment. In this embodiment, container 100 includes a bottom portion (not visible in FIG. 1) and a wall portion 101 similar to known coffee cups, for example.

In this embodiment, container 100 furthermore includes an internal cooling chamber 110 disposed in the upper portion of the container 100. The height H of the cooling chamber 110 can be selected according to preference. A lid member 115 includes a drinking aperture 116 is configured to be securable to the upper portion of the wall portion 101, such as by using a snap-fit configuration.

Figure 2:
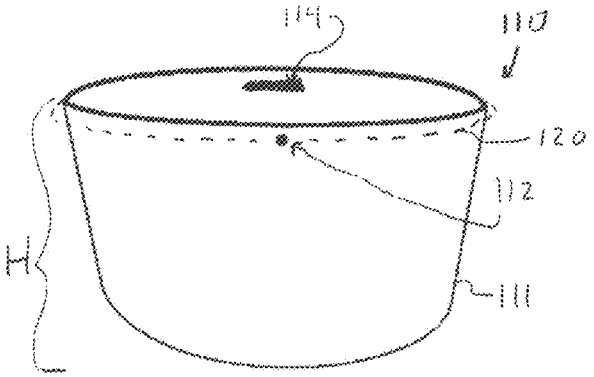
FIG. 2 is a front-elevational view of an internal cooling chamber of the multi-compartment beverage container of FIG. 1.
Figure 4:
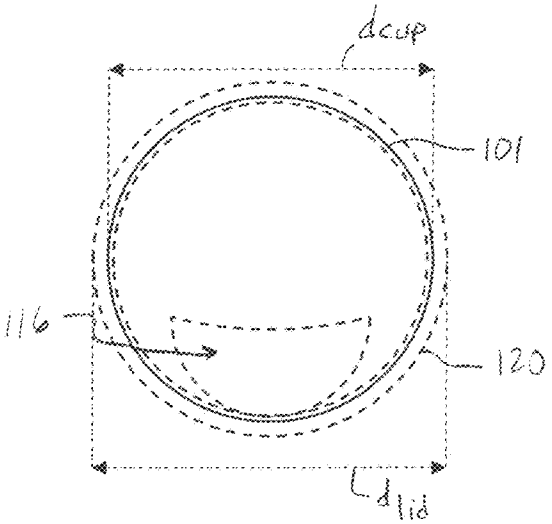
FIG. 4 is a top plan view of a lid of the multi-compartment beverage of FIG. 1.

In this embodiment, the internal cooling chamber 110 is disposed in the upper portion of the container 100 as illustrated e.g., in FIG. 1. A compartment 105 of the container 100 is defined by the volume not occupied by the internal cooling chamber. Such a configuration can be accomplished in several ways. For example, and without limitation, internal cooling chamber 110 can include a lip 120 as illustrated by the dashed lines in FIGS. 2, 4 and 5. In a preferred approach, lip 120 can be configured such that it extends over and around the circumference of the uppermost part of wall portion 101. For example, referring in particular to FIG. 4, the diameter of the lid lip, $d_{lid}$ is greater than the diameter of the cup rim, $d_{cup}$. Cooling chamber 110 can then be held in place, for example, by applying lid member 115 over lip 120. As is known in the art, beverage containers are often supplied in standard sizes with lids configured to snap-fit or screw on to the top portion. Thus, in one exemplary embodiment, internal cooling chamber 110 can be fabricated to fit industry-standard cup sizes, and so that the cooling chamber 110 is held in place by the compression force afforded by appropriately-sized snap-fit lids. In another exemplary embodiment, cooling chamber 110 can include threaded portions for engaging a complimentary threaded portion of a cup, affording a screw-on engagement of the cooling chamber 110 to a cup.

Figure 7:
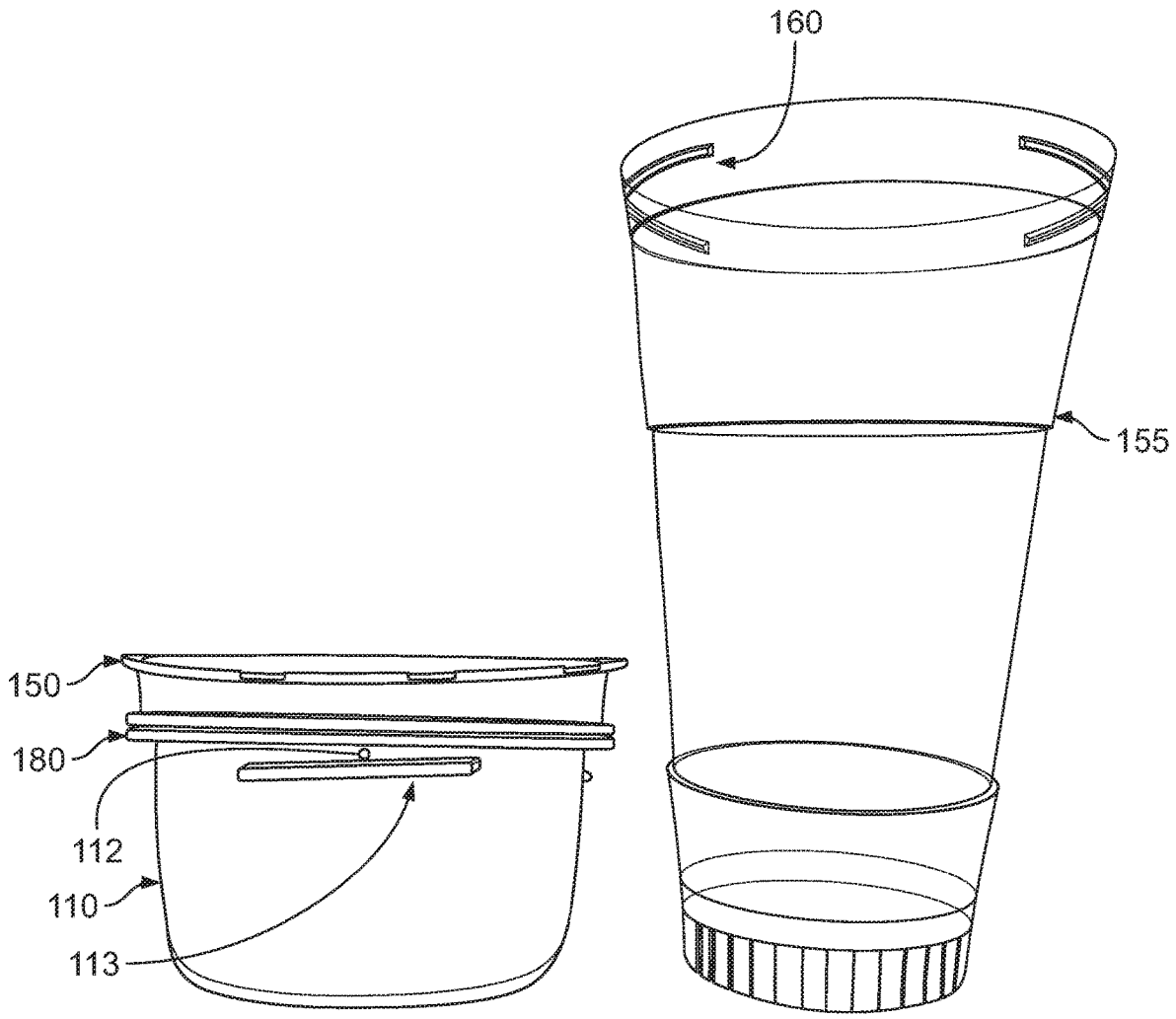
FIG. 7 shows an internal cooling chamber and a cup of a multi-compartment beverage container according to one embodiment.

For example, referring to FIG. 7, in one embodiment, cooling chamber 110 can include an exterior thread 113 configured to engage a complimentary thread 160 disposed on the interior portion of a cup 155, allowing the cooling chamber 110 to be screwed onto the cup 155. In the embodiment shown in FIG. 7, cooling chamber 110 is configured such that the rim of cup 155 confronts the underside of lip 180 which prevents liquid contents of the cup from spilling. A raised platform 150 is utilized in this embodiment to provide a surface from which to drink that extends above the rim of cup 155.

In another example, cooling chamber 110 can be integrally formed with lid member 115 in a single, monolithic piece. In such an approach, the uppermost circumferential rim 118 of cooling chamber 110 can be joined to the underside of lid member 115 in a coaxially-aligned configuration.

Figure 3:
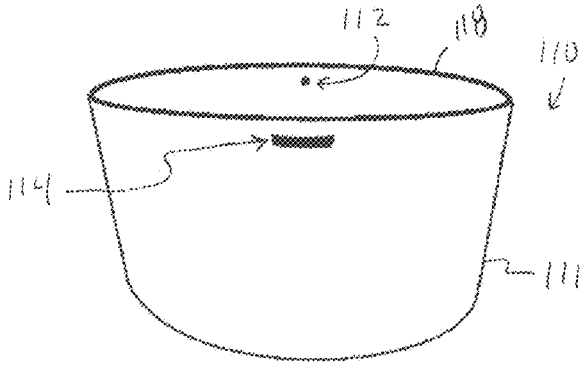
FIG. 3 is a rear-elevational view of the internal cooling chamber of FIG. 2.

Referring in particular to FIG. 3, in this embodiment, cooling chamber 110 includes a fill aperture 114 and a vacuum relief aperture 112. In this embodiment, the fill aperture 114 and the vacuum relief aperture are diametrically opposed. Each of the fill aperture 114 and vacuum relief aperture 112 are disposed offset from the top rim 118 of the cooling chamber 110, e.g., from about 1 mm to about 10 mm from the top rim 118.

Figure 5:
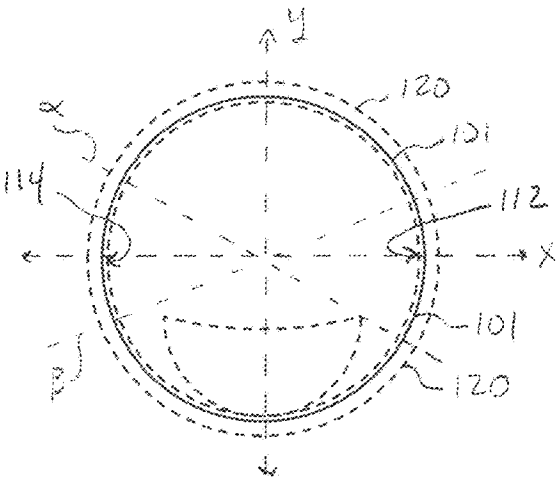
FIG. 5 is a top plan view of a lid of the multi-compartment beverage container of FIG. 1.

Referring now to FIG. 5, in this embodiment, the fill aperture 114 and vacuum relief aperture 112 are disposed on an axis (the x-axis) that is substantially perpendicular to an axis (the y-axis) on which the drinking aperture 116 is disposed. In the illustration of FIG. 5, the fill aperture 114 and vacuum relief aperture 112 are disposed on an axis that is 90 degrees from the axis on which the drinking aperture 116 is disposed; however, the positions of the fill aperture 114 and vacuum relief aperture 112 can be adjusted according to preference, such that each of the fill aperture 114 and the vacuum relief aperture 112 are disposed on axes that are, e.g., ±5°, ±10°, ±15°, ±20° degrees from the axis on which the drinking aperture 116 is disposed. The approximate angle ranges correspond to dashed lines α and β in FIG. 5.

Figure 6:
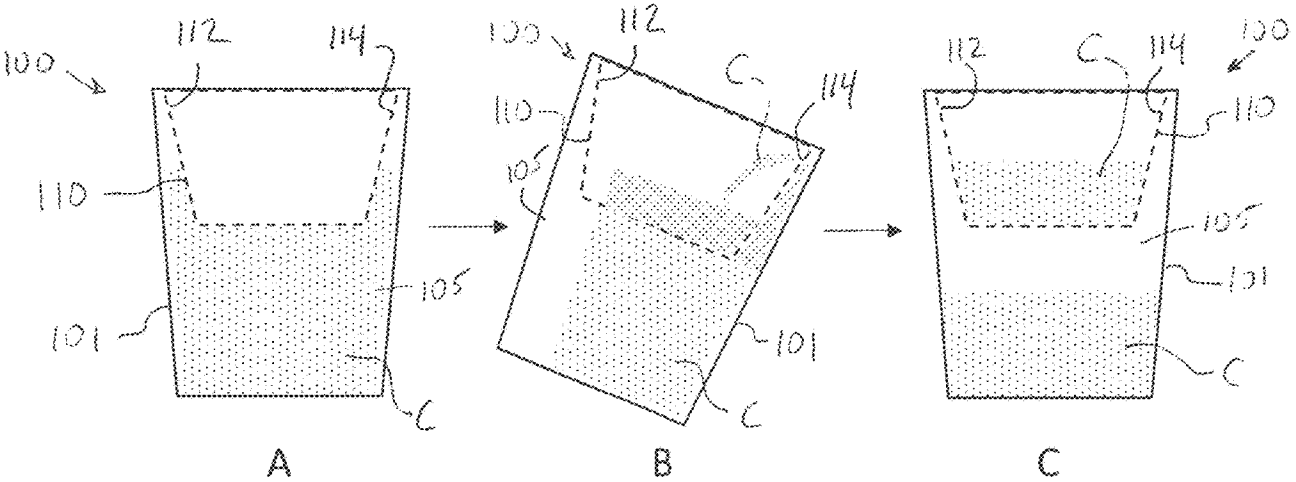
FIG. 6 illustrates use of the multi-compartment beverage container shown in FIG. 1.

FIG. 6 illustrates use of the multi-compartment beverage container 100 in views A, B and C. In view A, the container 100 has been filled with coffee C as illustrated by the shaded area within compartment 105 and cooling chamber 110 is empty. Next, at view B, the container 100 can be tipped toward the side on which the fill aperture 114 is disposed; doing so naturally makes the volume of coffee C rise toward the top of the cup and thus flows into fill aperture 114. As the cooling chamber 110 fills, the vacuum relief aperture 112 allows air pressure to equilibrate between the cooling chamber and compartment 105. Once a desired volume of liquid (in this example, coffee C) has been transferred from compartment 105 to cooling chamber 110, the container 100 can be tipped back to a regular vertical orientation (frame C of FIG. 6).

Without wishing to be bound by theory, it is postulated that the liquid within cooling chamber 110 can cool more quickly than if the volume of liquid were contained within compartment 105. Now, as the volume within cooling chamber 110 cools, the user may tip the container 100 toward them and drink the contents within the cooling chamber. It should be noted that the two tipping motions—one to fill the cooling chamber 110—and the other to drink the liquid contents therefrom, are preferably orthogonal, to reduce the likelihood of the user spilling contents from the drinking aperture 116 when attempting to fill the cooling chamber 100. The process of transferring liquid contents from chamber 105 to the cooling chamber 110 can be repeated as desired until the beverage is fully consumed.

A number of illustrative embodiments have been described. Nevertheless, it will be understood that various modifications may be made without departing from the spirit and scope of the various embodiments presented herein. For example, the multi-compartment beverage container can be formed of paper, plastic, or a combination of paper and plastic components. In one embodiment, a filter may be disposed in, on or across the filling aperture 114 to provide filtration of the beverage when transferring from compartment 105 to cooling chamber 110. Such an approach can be particularly useful when the beverage is tea or other liquids containing solid components. Lid 115 illustrated in the figures is one of many commercially available options in the foods industry; it should be understood that the general concepts disclosed herein can be applied to any lid type. Accordingly, other embodiments are within the scope of the following claims.

What is claimed is:

1. A multi-compartment beverage container, comprising:

a first container comprising:

a first floor and a first circumferential wall having a first height and a first upper-most rim portion;

a second container comprising:

a second floor and a second circumferential wall having a second height and a second upper-most rim portion;

a vacuum relief bore; and a filling aperture; and a lid member comprising a top side and a bottom side configured to engage said first upper-most rim portion;

wherein said second container is configured to fit within said first container and be held in an upper half of said first container;

wherein said lid member comprises a drinking aperture disposed on a first axis, and wherein said filling aperture is disposed on a second axis that is substantially orthogonal to said first axis; and wherein said drinking aperture is disposed on said second axis between 0° and ±20° to said first axis.

2. The multi-compartment beverage container of claim 1, wherein said vacuum relief bore is disposed from between 1 mm and 10 mm from said second upper-most rim portion of said second container.

3. The multi-compartment beverage container of claim 1, wherein said filling aperture is disposed from between 1 mm and 10 mm from said second upper-most rim portion of said second container.

4. The multi-compartment beverage container of claim 1, wherein said vacuum relief bore is diametrically opposite to said filling aperture.

5. The multi-compartment beverage container of claim 1, wherein said lid member further comprises a rim portion that extends at a non-zero angle to said second circumferential wall.

6. The multi-compartment beverage container of claim 1, wherein said second upper-most rim portion of said second container is joined with said bottom side of said lid member.

7. The multi-compartment beverage container of claim 6, wherein said lid member and said second container are coaxially aligned.

8. The multi-compartment beverage container of claim 1, further comprising a filter disposed in, on or across said filling aperture.

9. The multi-compartment beverage container of claim 1, wherein said second height of said second circumferential wall is between one-quarter and one-third of said first height of said first circumferential wall.

10. The multi-compartment beverage container of claim 1, wherein said second height of said second circumferential wall is between one-quarter and one-half of said first height of said first circumferential wall.

11. A multi-compartment beverage container, comprising:

a first container comprising:

a first floor and a first circumferential wall having a first height and a first upper-most rim portion;

a second container comprising:

a second floor and a second circumferential wall having a second height and a second upper-most rim portion;

a vacuum relief bore; and a filling aperture; and a lid member comprising a top side and a bottom side configured to engage said first upper-most rim portion;

wherein said second container is configured to fit within said first container and be held in an upper half of said first container;

wherein said lid member comprises a drinking aperture disposed on a first axis, and wherein said filling aperture is disposed on a second axis that is substantially orthogonal to said first axis; and wherein said drinking aperture is disposed on said second axis between 0° and ±5° to said first axis; or wherein said drinking aperture is disposed on said second axis between 0° and ±10° to said first axis; or wherein said drinking aperture is disposed on said second axis between 0° and ±15° to said first axis.

12. A multi-compartment beverage container, comprising:

a first container comprising:

a first floor and a first circumferential wall having a first height and a first upper-most rim portion;

a second container comprising:

a second floor and a second circumferential wall having a second height and a second upper-most rim portion;

a vacuum relief bore; and a filling aperture; and a lid member comprising a top side and a bottom side configured to engage said first upper-most rim portion;

wherein said second container is configured to fit within said first container and be held in an upper half of said first container;

wherein said lid member further comprises a rim portion that extends at a non-zero angle to said second circumferential wall; and wherein said rim portion has a diameter that is greater than a diameter of said first upper-most rim portion of said first container.

* * * * *